United States Patent [19]

Milano

[11] 4,043,680

[45] Aug. 23, 1977

[54] ARTIST'S BRUSH WITH DISPOSABLE CARTRIDGE

[75] Inventor: Lawrence V. Milano, Yonkers, N.Y.

[73] Assignee: The Raymond Lee Organization, Inc., New York, N.Y.

[21] Appl. No.: 696,358

[22] Filed: June 15, 1976

[51] Int. Cl.[2] ..... B43K 5/02

[52] U.S. Cl. ..... 401/40

[58] Field of Search ..... 401/40–43

[56] References Cited

U.S. PATENT DOCUMENTS

| | | | |
|---|---|---|---|
| 984,710 | 2/1911 | Shunk | 401/40 |
| 2,097,256 | 10/1937 | Salz | 401/40 |
| 3,720,473 | 3/1973 | Nakata | 401/40 |

*Primary Examiner*—Stephen C. Pellegrino

*Attorney, Agent, or Firm*—Stephen Wyden

[57] ABSTRACT

A shaft has a plunger forming a piston slidingly movable in a distal end of the shaft and constrained by a spring acting against a constriction formed in the shaftway of the shaft, a disk mounted in the shaft connected by an aperture to a narrow shaft the other end of which is attached to another disk mounted in the shaft, the chamber between the disk and the plunger containing a medium the chamber between the disks containing a pigment, apertures in the walls of the narrow shaft permitting mixing of the medium and the pigment, apertures in the other disk permitting dispensing of the pigment and medium into a dispensing chamber, a variety of tips attachable to a proximal end of the shaft including bristle brush tips, felt tips and fiber tips.

8 Claims, 6 Drawing Figures

ARTIST'S BRUSH WITH DISPOSABLE CARTRIDGE

I have invented a new and novel artist's brush which uses disposable cartridges. My brush uses a plunger mounted in a distal end of a cylinder to press a medium into a chamber containing a pigment material where the medium mixes with the pigment material and then the medium and pigment are discharged into a chamber connected to an interchangeable paint brush tip into which the pigment in the medium can move so that the paint brush can be used to apply the pigment and medium to a working surface.

My invention can be understood in view of the accompanying figures.

Figure 1:
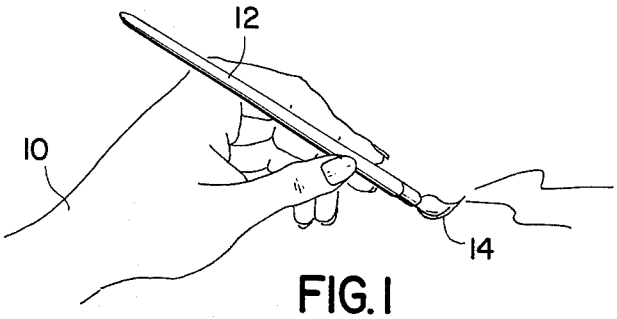
FIG. 1 shows the artists brush with disposable cartridge in use.

With regard to FIG. 1, a person is using their hand 10 to hold the paint brush 12 while using the paint brush tip 14 to apply pigment to a surface.

Figure 3:
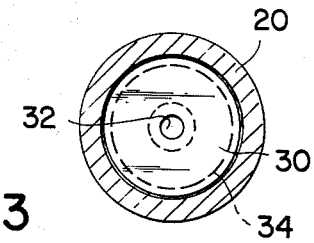
FIG. 3 is a section of the brush taken along the plane III—III of FIG. 2.
Figure 4:
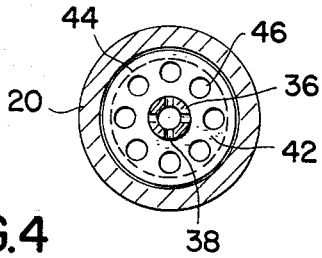
FIG. 4 is a section of FIG. 2 taken along the plane IV—IV.
Figure 5:
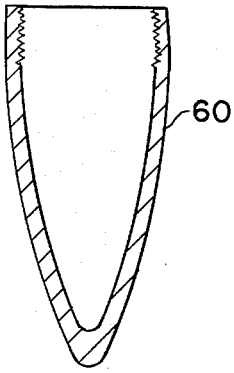
FIG. 5 shows a brush covering cap.
Figure 6:
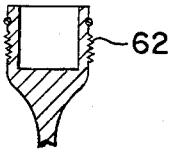
FIG. 6 shows an end sealing cap.
Figure 2:
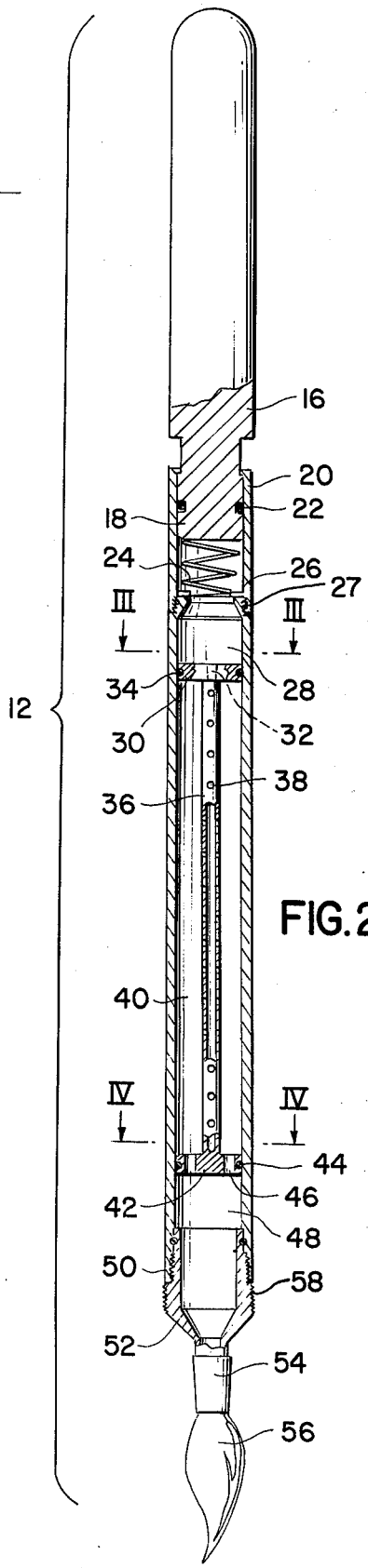
FIG. 2 is a partially sectioned side view of the brush.

With regard to FIGS. 2, 3 and, 4, 5 and 6 the paint brush, generally referred to by 12, is seen to consist of a plunger 16 which forms a piston 18 which rides within a distal end of the shaft 20. The piston 18 is sealed against the interior wall of the shaft 20 by a sealing ring 22. A spring 24 mounted beneath the lower surface of the piston 18 presses against a lip 26 formed by the wall of the shaftway 20. Shaftway 20 is threadingly connected 27 to the top of chamber 28. Medium contained in the chamber 28 which contains the spring 24 is prevented from downward movement by a disk 30. However, an aperture 32 in a disk 30 permits the medium to pass out of the chamber 28 while a sealing ring 34 around the disk 30 prevents the medium from leaving the chamber 28 around the sides of the disk 30. A narrow shaft 36 with a plurality of small perforations 38 extends down the shaft 20 carrying the medium into a mixing chamber 40 in which the pigment material can be stored. A lower disk 42 formed by the bottom end of the narrow shaft 36 is sealed against the shaft 20 by another sealing ring 44 and forms a plurality of passageways 46 not connected to the shaftway in the shaft 36. The apertures 46 communicate with another chamber 48 where the mixed pigment material and medium are dispensed. This dispensing chamber 48 is open at its lower end 50. A paint brush tip 52 may be threadingly secured in the open end 50 of the bottom of the cylinder 20. A narrow neck 54 secures the paint bristles 56 to the paint brush tip 52. A male threading 58 on the paint brush tip 52 can receive a cap 60 to seal the paint brush when not in use. The cap 62 can be inserted to seal the end 50 when the tip 52 is removed.

Furthermore it is to be noted that a variety of paint brush bristles may be provided with different types of painting strokes and that other types of application tips, such as felt tips and fiber tips, can be used interchangeably with the paint brush tip 52.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An artists brush with disposable cartridge, comprising:
   - a shaft,
   - a plunger slidingly insertable in a distal end of the shaft,
   - a first disk mounted in the shaft below the plunger and forming a medium storing chamber above the first disk,
   - a second disk mounted in the shaft below the first disk and forming a pigment storing chamber between the first disk and the second disk and forming a dispensing chamber below the other disk,
   - means for introducing the medium through the disk and into the pigment chamber,
   - means of dispensing the pigment and medium through the other disk into the dispensing chamber,
   - a tip removably attachable to a proximal end of the shaft, thereby closing the dispensing chamber, and
   - covering means removably attachable over the tip.

2. The brush of claim 1, wherein the tip is chosen from among a brush tip, a felt tip, and a fiber tip.

3. The brush of claim 1, wherein the tip comprises:
   - the tip narrowing to form a neck, and
   - bristles fixedly inserted in a distal end of the neck,
   - whereby the pigment and medium may flow onto the bristles and may be applied to a surface therefrom.

4. The brush of claim 1, further comprising:
   - the shaft forming a constriction above the first disk,
   - a spring resiliently inserted in the shaft above the constriction and constraining the plunger,
   - the plunger forming a piston tip which slidingly moves within the distal end of the shaft, and
   - a sealing ring mountable around the piston and engaging the interior wall of the shaft, whereby the medium may not flow out around the piston when the piston is downwardly pressed.

5. The brush of claim 1, wherein the means of communicating between the medium chamber and the pigment chamber comprises:
   - a narrow shaft attached to a proximal surface of the first disk and to a distal surface of the second disk,
   - the first disk forming an aperture communicating with a shaftway of the narrow shaft,
   - the narrow shaft forming a plurality of apertures along a length of the narrow shaft and communicating between the shaftway in the narrow shaft and the pigment chamber, and
   - the shaftway in the narrow shaft sealedly connected to the distal surface of the second disk.

6. The brush of claim 5, further comprising:
   - a sealing ring attached around the first disk and engaging the interior surface of the shaft, thereby sealing the first disk between the medium chamber and the pigment chamber, and
   - another sealing ring attached around the second disk and engaging the interior surface of the shaft, thereby sealing the second disk between the pigment chamber and the dispensing chamber.

7. The brush of claim 6, wherein the means of dispensing the pigment and medium mixture into the dispensing chamber comprises a plurality of apertures formed in the second disk and communicating between the pigment chamber and the dispensing chamber.

8. The brush of claim 7, further comprising a sealing ring attached around a distal end of the tip and engaging the interior surface of the proximal end of the shaft, thereby sealing the tip in the end of the shaft and preventing the medium and pigment from leaving the dispensing chamber through the end of the shaft.

* * * * *